US005343173A

United States Patent [19]

Balodis et al.

[11] Patent Number: 5,343,173

[45] Date of Patent: Aug. 30, 1994

[54] PHASE SHIFTING NETWORK AND ANTENNA AND METHOD

[75] Inventors: Miroslaw Balodis, Garden Grove; Hassan Zamat, Hacienda Hts., both of Calif.

[73] Assignee: MESC Electronic Systems, Inc., Fort Wayne, Ind.

[21] Appl. No.: 722,701

[22] Filed: Jun. 28, 1991

[51] Int. Cl.[5] ..... H01P 1/213; H01P 5/12

[52] U.S. Cl. ..... 333/126; 333/128; 333/161; 343/895

[58] Field of Search ..... 333/126–129, 333/134, 136, 161, 26; 343/895

[56] References Cited

U.S. PATENT DOCUMENTS

| | | | |
|---|---|---|---|
| 2,633,531 | 3/1953 | Nelson | 333/127 X |
| 3,135,960 | 6/1964 | Kaiser, Jr. | 343/895 X |
| 3,599,220 | 8/1971 | Dempsey | 343/895 X |
| 4,356,462 | 10/1982 | Bowman | 333/128 |
| 4,460,877 | 7/1984 | Sterns | 333/26 |
| 4,725,792 | 2/1988 | Lampe, Jr. | 333/128 X |
| 4,812,792 | 3/1989 | Leibowitz | 333/238 |
| 5,097,233 | 3/1992 | Pekarek | 333/128 X |
| 5,126,704 | 6/1992 | Dittmer et al. | 333/128 X |
| 5,146,191 | 9/1992 | Mandai et al. | 333/161 |

FOREIGN PATENT DOCUMENTS

| | | | |
|---|---|---|---|
| 2170358 | 7/1986 | United Kingdom | 333/128 |

OTHER PUBLICATIONS

Bert et al, *The Traveling-Wave Divider/Combiner*, IEEE Trans. on MTT, Vol. MTT-28, No. 12, Dec. 1980, pp. 1468–1473.

*Primary Examiner*—Paul Gensler

*Attorney, Agent, or Firm*—Richard T. Seeger

[57] ABSTRACT

A method of and apparatus for transmitting or receiving circularly polarized signals is disclosed. The technique employs a phase shifting network for connection between an antenna and a radio transmitter or receiver to produce a phase shift when transmitting or eliminate a phase shift when receiving. In one preferred embodiment, a dielectric substrate has a phase shifting network or printed circuit lines defining a signal transmission paths between a radio connection terminal and a plurality of antenna element connection terminals for coupling a multi-element antenna and a radio. Each transmission path is phase shifted relative to an adjacent path by a predetermined amount by each path having progressively equally different electrical length to provide equal phase shift of a radio frequency signal progressively through the transmission paths. Adjacent path pairs are progressively joined at combiner nodes of equal power division by shunt connection line segments to that the power at each antenna connection terminal is equal to the power at the radio connection terminal divided by the number (typically four) of antenna terminals.

40 Claims, 4 Drawing Sheets

FIG. 9
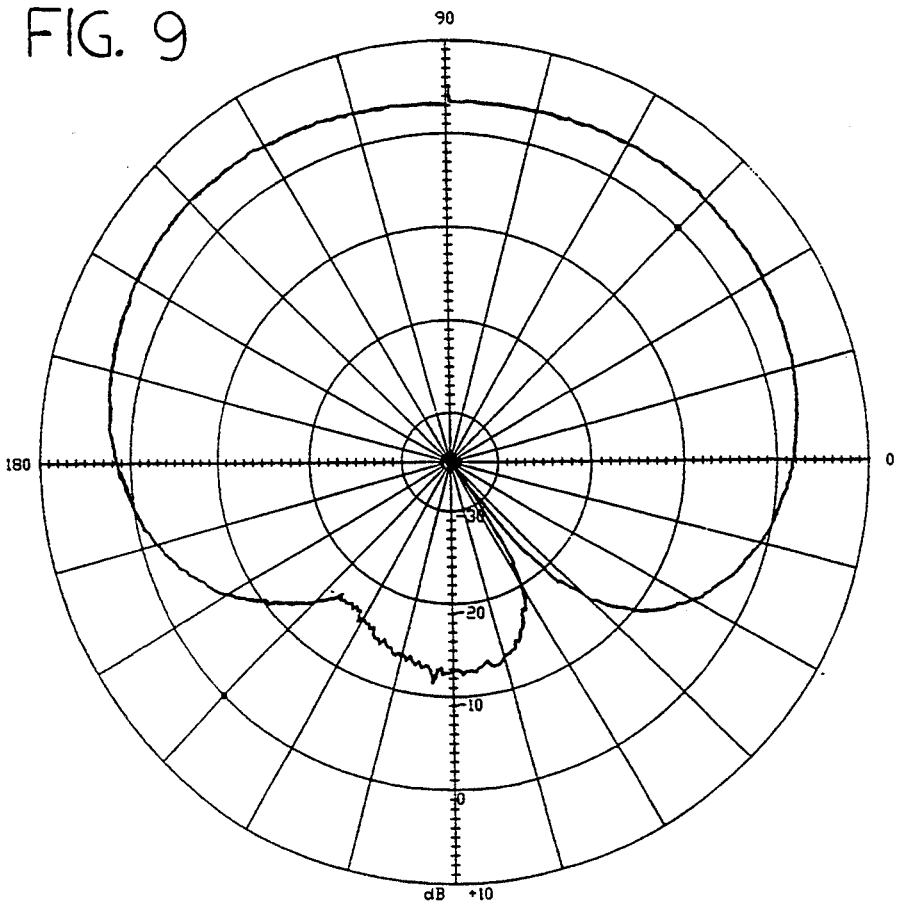
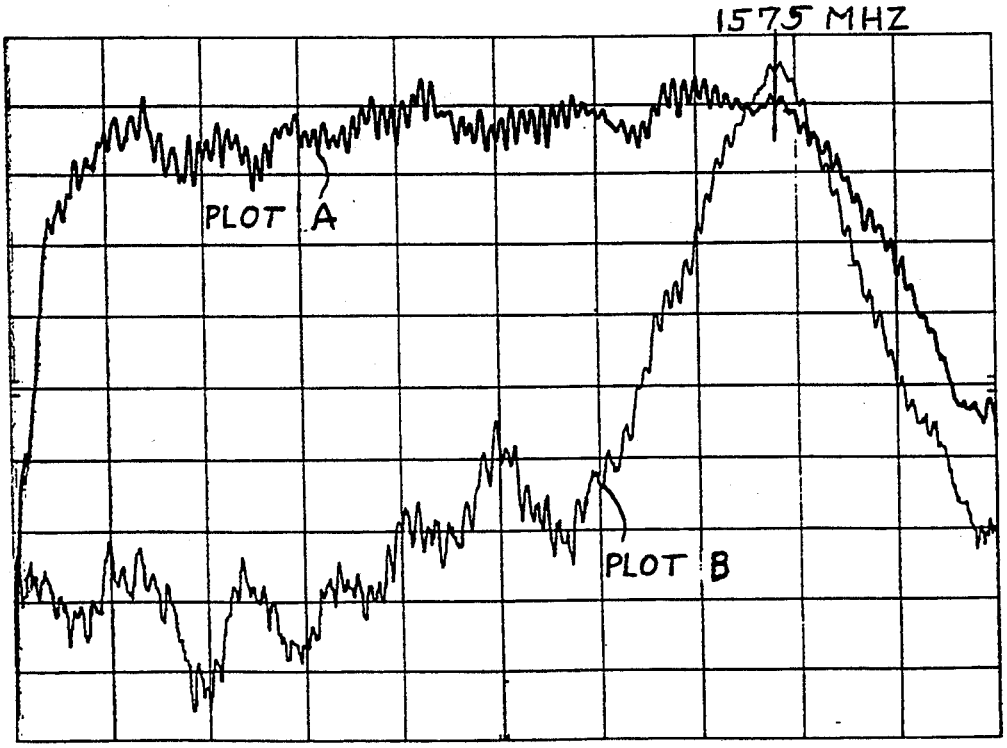
FIG. 10

PHASE SHIFTING NETWORK AND ANTENNA AND METHOD

BACKGROUND OF THE INVENTION

1. Field of the Invention

The invention relates to antennas for sending and receiving circularly polarized signals and to phase shifters and methods phase shifting for circularly polarized signals for use with such antennas. In particular, the invention relates to a low cost apparatus and method of phase shifting, and an antenna in combination with such method and apparatus.

2. Background of the Invention

Circularly polarized signals are well known, being a composition of two orthogonally polarized waves of equal frequency, in equal magnitude, propagating in phase offset. A common phase offset is 90° usually designated phase quadrature. The polarization will be either right-handed or left-handed depending on the relative sense of the resultant circularly polarized wave as produced by two phase offset orthogonal waves. In a circularly polarized signal at any point in a given cycle, the resultant energy of the wave will be the resultant of the combined energy of the horizontal component, and the vertical component.

As horizontal and vertical energy components represent components of a sinusoidal wave the resultant energy component is constant, thus providing a circular locus for the resultant energy. While sweeping out a circle, the resultant energy moves forward at the velocity of propagation, which defines a helix about the propagation axis. See *Bekowitz, Basic Microwaves,* Hayden Book Company, Inc., New York 1966.

When receiving or transmitting circularly polarized signals it is necessary to phase shift the signals, either to produce the phase shift when transmitting or to eliminate it when receiving. Phase shifting may be accomplished in a number of ways, however, in the present discussion only the technique of adjusting the physical length of the transmission line is relevant. See *White, Microwave Semiconductor Engineering,* Van Nostrand Reinhold Co., 1982.

It is well accepted that the theory of reciprocity applies to antenna theory; meaning that an antenna can be seen and analyzed as being in either transmitting or receiving mode. Most commonly, a discussion of antenna operation speaks in the transmitting mode. The presently preferred application of the invention is in the receiving mode and therefore the description speaks primarily in the receiving mode. The invention is equally applicable to both receiving and transmitting modes.

The particular application of the presently preferred mode of practicing the invention is for receiving circularly polarized signals from the satellite system known as Global Positioning System (GPS). The GPS satellites broadcast in two frequencies, the L1 frequency at 1575.42 MHZ and the L2 frequency at 1227.6 MHZ. in one of the present preferred embodiments, the technique is applied to the L1 frequency. In another embodiment the invention is applied to a dual frequency mode, in which case the second frequency can be the GPS L2 frequency.

In the past, phase shifting for GPS receiving antennas has been accomplished by adjusting the length of the antenna elements during the manufacturing process while the antenna is attached to a test instrument. This technique which must be performed by an assembler, is expensive and time consuming and results in antennas of varying specifications.

Prior art quadrifilar helix antennas are based on the same principle as described herein for the present invention, i.e. four antenna elements are driven in quadrature phase sequence by a phase shift network. But prior phase shift network configurations are considerably more complicated and expensive to manufacture than that described for the present invention. Typically, the prior quadrifilar elements are driven from the top of the assembly, with a coaxial phase sequencer/transformer made from rigid coax elements bringing up the signals from the bottom of the structure to the top. Most currently manufactured quadrifilar antennas are built this way, and their complexity is reflected in their relatively high cost. Further increase in manufacturing cost is caused by the difficulty of maintaining tight dimensional tolerances of the phase sequencer structure. Antenna manufacturers typically work around the dimensional accuracy problem by custom tuning the individual element length.

Phase shifting requires high precision, particularly in the length of the phase shifting line. For example, 1° of phase at the GPS L1 frequency having a wavelength of 19.04 centimeters is ½ millimeter. In other words, to obtain 2° of phase accuracy, the phase shift lines must have a precision of 1 millimeter. By prior methods of manual adjustment for the length of the antenna phase shift element, precise expensive manual labor is required. The present invention provides the high precision required, in a low cost microstrip or stripline printed circuit. Further, the simplicity provided by the network reduces space requirements and cost.

SUMMARY OF THE INVENTION

The present invention resides in a method and apparatus for providing a phase shifting network for connection between an antenna and a radio receiver or transmitter. The network provides phase shifting, equal power splitting and impedance matching into each of a plurality of antenna elements. A basic building block called a bifilar module is defined having a branched line pair shunt connected, one side of the line pair being phase shifted by an added circuit length, relative to the other side of the pair. The branched line pairs have the same impedance and electrical length and therefore effect an equal power division. By selectively networking the bifilar modules, phase shifting (also referred to as phase sequencing) for any number of antenna elements can be accommodated with equal power at each antenna element. The selective networking of paired power splits permits high efficiency and low cost. The network is also impedance matched between the antenna elements and the receiver or transmitter. Therefore, the circularly polarized signal as received by a plurality of antenna elements and fed into the network is phase shifted progressively to present an in-phase signal at the receiver. The antenna elements are in helical form arranged in a volute.

Also the invention resides in constructing the network as microstrip transmission lines on one face of a dielectric substrate, the other face having a ground plane or as striplines in a multilayer construction. By this construction, using conventional printed circuit board manufacturing techniques, the phase shifter and in fact the entire antenna may be made to highly reliable, precise and repeatable specifications at very low cost. Also, a small amount of space is all that is needed.

In its most specific form, the invention is a method and apparatus for a quadrifilar antenna, having four helical elements in volute form attached to the phase shift network on a printed circuit board. In another form the bifilar modules can be printed on separate substrates and connected by plated-through holes so that the entire network will be very small. It is understood that the term "microstrip" refers to the circuit lines printed on a dielectric base layer, and "stripline" refers to the construction of circuit lines between ground planes. The multilayer stripline configuration facilitates impedance matching over large impedance ratios between the radio circuit and the antenna elements, by providing the ability to change the dielectric thickness of selected layers. Without this it may not be practical to provide matching for large impedance ratios.

BRIEF DESCRIPTION OF THE DRAWINGS

FIG. 9 is a gain pattern obtained from the quadrifilar antenna.

FIG. 10 is a set of comparative performance graphs.

DESCRIPTION OF THE INVENTION

In the following description, the invention will be described in terms of the presently preferred embodiment, as a receiving antenna and phase shift network; however, due to the reciprocity theory of antenna function, certain aspects of the description may also speak in transmitting terminology. The invention applies equally in transmitting and receiving mode of operation and it is intended that the reference to receiving or direction of flow of current be taken to include transmitting and the opposite direction of flow of current. Therefore the term "radio", while specifically referring to a radio receiver in the preferred embodiment is also taken to mean a radio transmitter.

Figure 1:
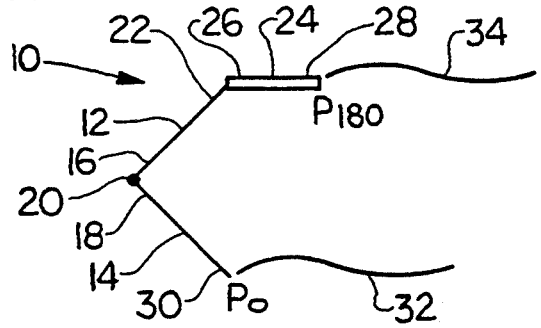
FIG. 1 is a schematic diagram of a bifilar module circuit for phase shifting a two element antenna and for use as a building block for use with other antennas.

FIG. 1 shows the basic circuit configuration of the invention called a bifilar module 10 (also hereinafter referred to as BM). A first combiner line segment 12 and a second combiner line segment 14 are shunt connected at their first ends 16 and 18 at a combiner node 20. At the second end 22 of the first combiner line segment 12 is connected a phase shift line segment 24 having a first end 26 and a second end 28. The second combiner line segment has a second end 30. When used as a building block, the effective electrical length $\phi_s$, of the phase shift segment 24 is selected to achieve desired phase shift, at the desired frequency, as will be seen in detail below. It is fundamental to the bifilar module 10 that the first combiner line segment 12 and the second combiner line segment 14 be of equal effective electrical length $L_e$ and have the same characteristic impedance, thereby providing equal power splitting or addition of the power at the combiner node 20 into or from the combiner line segments 12 and 14. Also the impedance of the phase shift line segment 24 should be such as to transfer the load impedance at the antenna element attached at 28 to be presented to the first combiner line segment 12. Therefore each of the combiner line segments 12 and 14 will see the same load impedance. Further it is preferred that the effective electrical length $L_e$ of each of the combiner line segments 12 and 14 be 90° of the wave cycle of the signal to be processed.

The bifilar module can be used as a phase shift network for a 2 element antenna, the antenna element 32 being connected to the second end 30 of the second combiner line segment 14 and the antenna element 34 being connected to the second end 28 of the phase shift line segment 24. The antenna elements 32 and 34 are in volute configuration and otherwise designed by application of known design principles. The phase shift line segment 24 will have an effective electrical line length of 180° of wave cycle for the selected wavelength of the signal to be processed. The second end 30 is arbitrarily designated $P_0$ to signify an arbitrary relative zero phase condition. The second end 28 is therefore designated $P_{180}$ to designate a 180° phase shift $\Delta\phi$ between the two points.

The antenna elements 32 and 34 provide a load impedance $Z_L$ at points $P_0$ and $P_{180}$. Phase shift line segment 24 will have impedance equal to the impedance of the antenna in order to transfer that impedance value to the second end 26 of the first combiner line segment.

The effective electrical length $L_e$ of combiner line segments 12 and 14 are equal, and their impedance is equal. Preferably $L_e$ is 90°, so that by application of conventional impedance matching calculations the impedance of lines 12 and 14 will be given by $\sqrt{2}Z_o$ and the impedance at the combiner port will be the same as the antenna.

Figure 2:
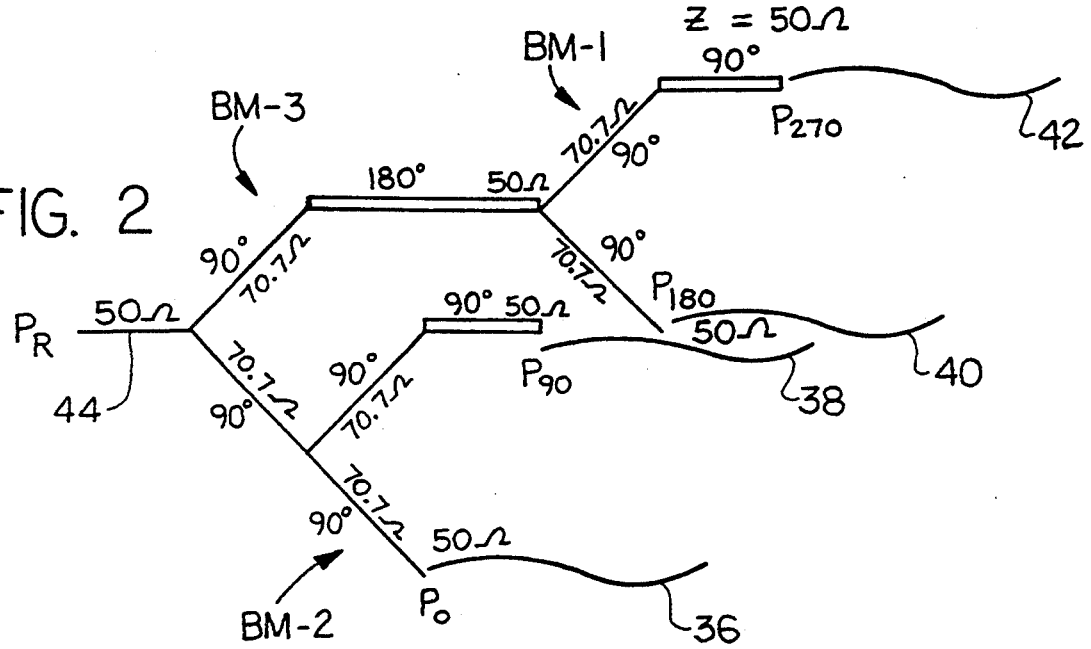
FIG. 2 is a schematic diagram of a quadrifilar module circuit for phase shifting a four element antenna.

FIG. 2 shows a quadrifilar antenna network. The quadrifilar network is employed with four antenna elements 36, 38, 40 and 42 and is constructed of a specific combination of bifilar modules (BM). A first tier of BM, that is two BM-1, BM-2 provide the antenna connection ports to each of the antenna elements. The antenna connection ports are designated by their sequential or successive phase shift, $P_0$ being the arbitrary zero phase port followed sequentially by $P_{90}$, $P_{180}$ and $P_{270}$ designating the amount of total phase shift at each port relative to $P_0$. A second tier has a single bifilar module designated BM-3. In BM-3 the phase shift segment is twice the phase shift in BM-1 and BM-2. The combiner line segments are preferably 90° of wavecycle. Also a stem line segment 44 is provided to enable convenient connection to a radio receiver co-axial connection port designated $P_R$.

The network can also be described as comprising transmission lines which establish four signal paths, extending from the connecting points of the antenna elements to the radio. These paths are designated $P_0$, to $P_R$ for the arbitrarily designated zero phase path; $P_{90}$ to $P_R$ for the 90° phase shifted path, $P_{180}$ to $P_R$ for the 180° phase shifted path, and $P_{270}$ to $P_R$ for the 270° phase shifted path. Each combiner line segment has an effective electrical line length equal to 90° of signal cycle or $\frac{1}{4}$ wavelength. The antenna design presents a 50 ohm load impedance at each antenna connection port. Using conventional impedance matching theory, the impedance for each line segment is as shown in FIG. 2. Therefore, the load impedance of the network presented to the receiver at $P_R$ is 50 ohms. In the schematic, the 50 ohm line segments are shown as wider than the 70.7 ohm segments which replicates the actual width relationships. Therefore each transmission path will be phase shifted, sequentially by 90° and the power at each of the four antenna connection is equal and is $\frac{1}{4}$ the power at the radio port $P_R$.

In the preferred embodiment of a quadrifilar antenna, antenna elements at $P_0$ and $P_{180}$ will establish one open loop and antenna elements at $P_{90}$ and $P_{270}$ will establish a second open loop. By appropriate design, a characteristic impedance of 50 ohms is provided at each antenna element and therefore at each antenna connection port. Each phase shift element in the BM-1 and BM-2 is 90° and, in BM-3 it is 180°, in order to provide the $\Delta\phi$ of 90° where $\Delta\phi$ is the change or shift in phase between successive antenna elements. The effective electrical length of each combiner line segment in a given tier must be equal in order to have the total power seen at the final radio port $P_R$ be equally divided at each antenna element. It is further preferred that each combiner line segment be 90° effective electrical length. By this configuration the impedance $Z_o$ of 50Ω from each antenna element is presented to each combiner line segment. As the length of each combiner line segment is 90°, making its impedance $\sqrt{2Z}$ or 70.7 ohms, will give 50 ohms at the combiner nodes. Therefore the impedance of 50 ohms is present at the combiner ports after shunt combination of the paired combiner line segments. An impedance of 50 ohms is chosen as this is a commonly used input impedance for radio receivers.

The actual length of each microstrip line segment, for 90° of wavecycle phase depends upon the signal wavelength, the relative dielectric constant, the effective dielectric constant, and the desired impedance all of which can be established according to known engineering techniques.

A primary feature of the network is use of power splitting combiner nodes branching into the combiner line segments, with no relative phase shift. With equal power splitting, there is received equal power at each of the antenna terminals and equal power at the end of each combiner line segment. Therefore, the schematic of FIG. 2 provides 90° phase shift in a network which is impedance matched and equally power divided at the antenna connection ports.

Figure 3:
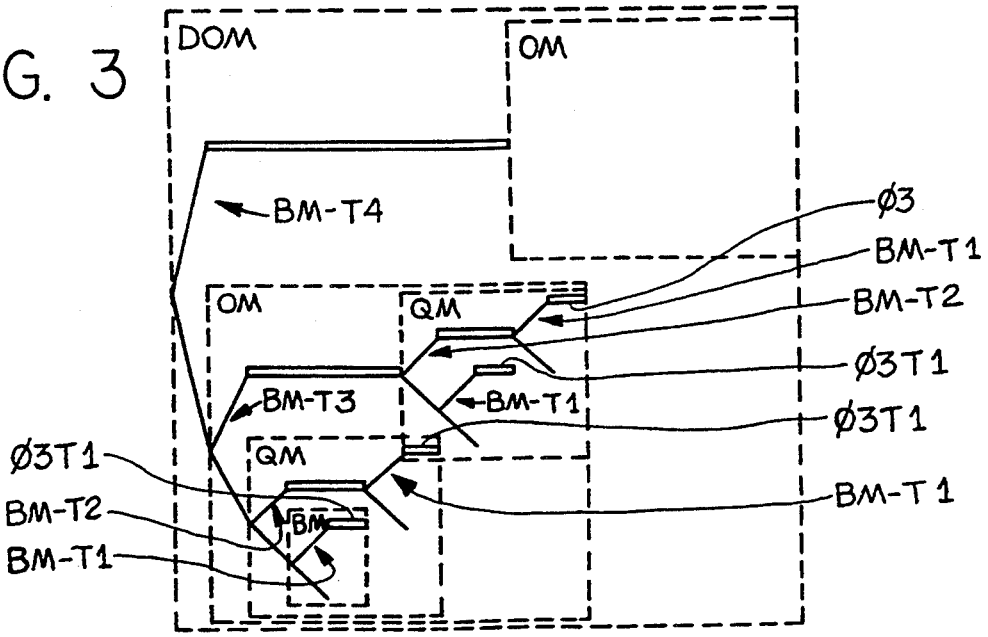
FIG. 3 is a schematic diagram for building phase shift modules through a 16 element antenna.
Figure 5:
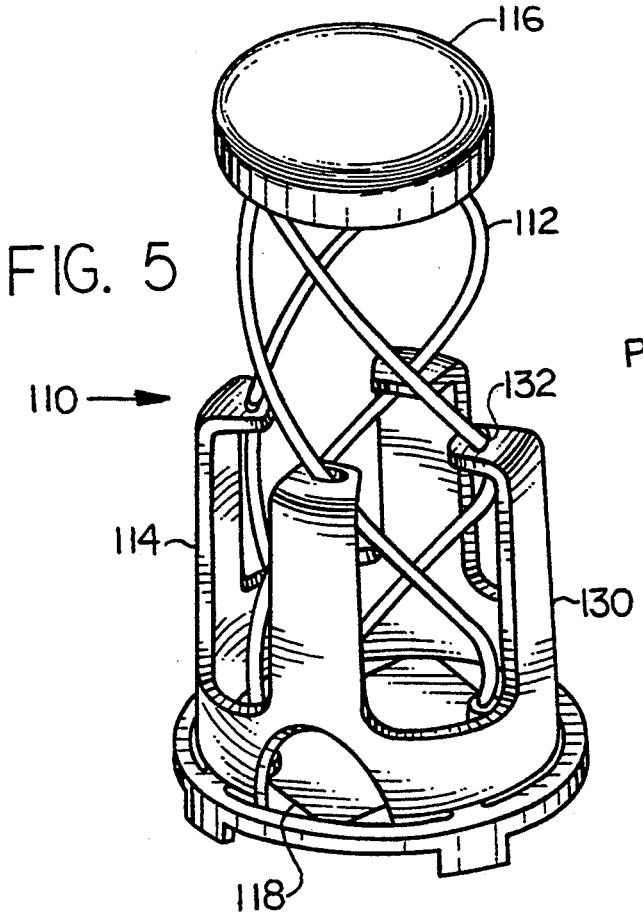
FIG. 5 shows a perspective view of the quadrifilar antenna structure, including the phase shifter.

FIG. 3 shows a larger scale configuration in which the bifilar module building block is progressively used to create a quadrifilar module (QM) (4 antenna elements) an octifilar module (OM) (8 antenna elements) and a duo-octifilar modular (DOM) (16 antenna elements). Each of these is legended and shown enclosed in dash lines. To provide equal power division each pair of combiner line segments in a given tier must be of the same impedance and have the same effective electrical line length.

A first tier of BM designated BM-T1 are attached to adjacent paired antenna elements. The first tier have phase shift segments $\phi_s$—T1.

A second tier of BM designated BM-T2 are attached to the combiner nodes of adjacent pairs of BM-T1. The second tier have phase shift segment $\phi_s$—T2 which is equal to $2*\phi_s$—T1.

A third tier of BM designated BM-T3 are attached to the combiner nodes of adjacent pairs of BM-T2. The third tier have phase shift segments $\phi_s$—T3 equal to $4*\phi_s$—T1. Successive tiers are similarly attached to adjacent paired BM of the next prior tier. The phase shift segment of a BM for a given tier, T follows the rule $\phi-T=2^{A-1}\phi_s$, where A is the rank of the tier and $\phi_s$ is the phase shift between successive antenna elements. Therefore the 3rd tier phase shift segment $$\phi-T3=2^{3-1}\phi_s=4\phi_s$$

Similarly the fourth tier phase shift segment $$\phi-T4=2^{4-1}\phi_s=8\phi_s$$

It can also be seen that the building scheme can be described in terms of pairing the next lower network through a joining bifilar module. For example the octifilar module (OM) is constructed by a pair of quadrifilar modules (QM) joined by a bifilar module. The phase shift in the joining bifilar module will be twice that in the adjacent building block bifilar modules.

Using the transmission line analysis as previously described, it can be seen that each antenna connection port will be successively phase shifted by the same amount. The phase shift will always follow the rule $\phi_s=360*B/N$ where B is an integer and N is the number of antenna elements.

Figure 4:
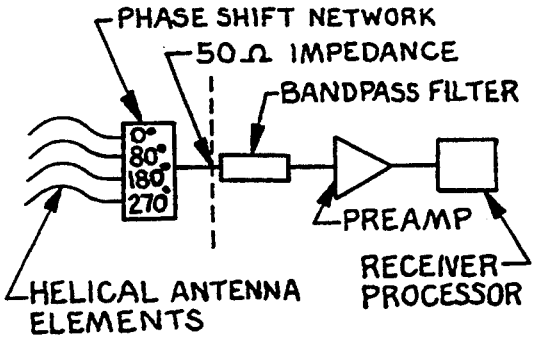
FIG. 4 is a flow chart showing the antenna elements through to a receiver-processor.

FIG. 4 shows in flow chart form the general context for use of the preferred quadrifilar antenna and phase shift network, whereby the antenna elements are connected to the phase shift network which in turn is connected to the receiver. This flow chart applies to most receivers in general and in particular to a GPS receiver such as those made by Magnavox in Torrance, Calif. Those receivers have an input impedance of 50 ohms. The quadrifilar antenna and phase shift network herein described is particularly designed for such application.

The phase sequencer of the present invention is compatible with any multiple of quarter wave antenna structures. Quarter wave and three quarter wave antennas are characterized by the physical length of the antenna elements equaling either quarter or three quarter wavelength at the antenna operating frequency. These antennas have elements that are open at the ends opposite from the driven ends. That is, they follow open loop antenna theory. The preferred embodiment is a three-quarter wavelength quadrifilar. Half wave and full wave antennas contain antenna elements whose physical length is equal to half or full wavelength at the operating frequency. These antennas have elements that are connected together at the ends opposite from the driven ends. In general half wave and full wave antennas can be built smaller than quarter wave and three quarter wave antennas, but are more difficult to manufacture because their elements must be connected together at the ends. Characteristic impedance of the antenna elements in a volute antenna is dependent upon the volume of the cylinder enclosed by the elements, and it increases with increasing diameter of the volute. The phase sequencer circuit described herein is universal in that it can be configured to match any practical antenna element impedance value.

The primary advantages of the new quadrifilar antenna/phase sequencer configuration are ease of manufacturing and low cost while achieving the necessary precision. These advantages are realized despite the requirements of high dimensional accuracy. The phase sequencer printed circuit construction is inherently accurate dimensionally because the sequencer is chemically etched from a lithographically reproduced pattern or other conventional printed circuit board manufacturing technique. High quality printed circuit substrate is used to provide negligible variation of characteristics affecting phase shift and impedance, i.e. dielectric constant, dielectric thickness, conductor thickness and surface uniformity. Although high quality printed circuit materials are relatively expensive, only a small quantity (about two square inches) is needed in an L-Band typical antenna. The antenna elements can be accurately manufactured at low cost on a spring winding machine. Thus the antenna described herein can be manufactured in large quantities at low cost, while maintaining high dimensional accuracy, without the need for individual electrical adjusting or tuning of finished units. In the illustrated antenna, (FIGS. 5 through 8) the phase sequencer is etched on a 1.5 inch square printed circuit board, designed to drive the four helix elements formed from 0.090-inch diameter wire. The wire ends are soldered directly into the phase sequencer. The phase sequencer and quadrifilar antenna element subassembly then mounts on a molded plastic support and finally is installed inside a molded plastic radome (not illustrated) which provides rigidity to the structure and protection from the environment. If necessary, additional electronic circuits such as low noise amplifiers, filters, diplexers or power amplifiers can also be mounted inside the radome at the bottom of the structure. Provisions can also be added for mounting the entire assembly at the desired location such as the roof of a building, the dome of a truck, or the mast of a ship.

FIGS. 5 through 8 show the invention as applied to a quadrifilar volute antenna for use in receiving the L1 GPS signals at 1575.42 Mhz. A complete discussion of the nature of GPS signals is available from numerous sources.

Referring to FIGS. 5 through 8 the primary parts of the antenna 110, are four identical helical antenna elements 112 which are supported in a support base 114. The antenna elements 112 are also held in proper position at their outer ends by a cap 116. A dielectric board 118 fits onto the support base 114. Printed on the upper face of the dielectric board 118 is the phase shift network 120, while on the reverse face is the ground plane 122 as seen in greater detail in FIG. 8. A coaxial cable 124 connected to the microstrip at 1 (FIG. 8) leads from the antenna to the radio. The antenna structure is installed in a container comprising a radome and a mounting foot which are not illustrated.

The volute quadrifilar antenna of this invention employs a pair of three-quarter wavelength orthogonally oriented open loops. When constructed as herein described, the antenna will provide a desirable gain pattern as seen in FIG. 9.

The antenna elements 112 are constructed of 13 gauge steel wire AISI type 1010, 1015 or 1019 suitably finished. The antenna elements 112 are each formed into a helix having a pitch of 5.20 inch and a diameter about the axis of the wire of 1.25 inch. The helix wires are set 90° apart to form a volute. The total height of the volute above the circuit board is 3.8 inches.

The support base 114 has four support legs 130 and each of which has a hole 132. Also, the support base 114 has tabs 134 with holes 136. The printed circuit board 118 fits against the bottom of the tabs 134 but spaced by spacers 140, this assembly being held together by soldering the antenna elements in place at 142.

The antenna elements 112 are fixed in place by means of the cap 116 in which four recesses receive the upper ends of the antenna elements 116. The antenna elements pass through the holes 132 and 136 and are soldered onto the printed circuit board at antenna connection ports $P_0$, $P_{90}$, $P_{180}$ and $P_{270}$.

Therefore, after soldering, the cap 116, the support base 114, antenna elements 112 and printed circuit board 118 form a durable, rigid structure.

Figure 8:
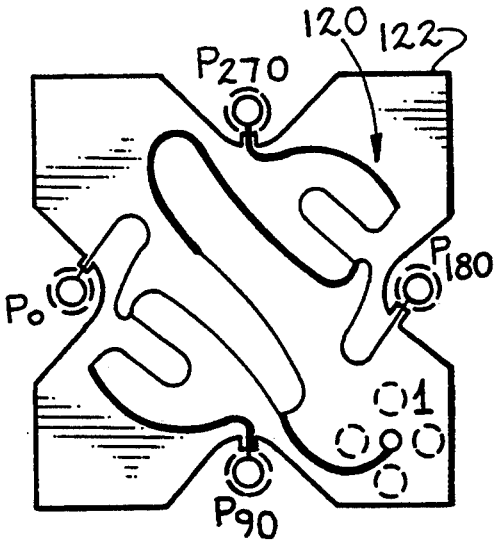
FIG. 8 shows the circuit board layout for the quadrifilar microstrip phase shift network as used in FIGS. 5, 6 and 7 and according to the schematic of FIG. 2.
Figure 7:
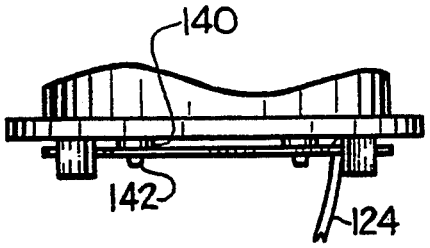
FIG. 7 shows a partial side view of the structure of FIG. 6 showing the phase shifter as mounted in the antenna structure.
Figure 6:
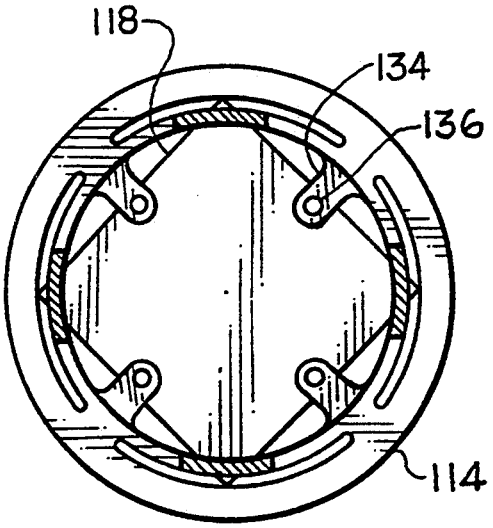
FIG. 6 shows a partial top view of the structure of FIG. 5 showing the phase shifter as mounted in the antenna structure.

FIG. 8 shows a preferred layout of the quadrifilar network 120 as it is printed on the dielectric substrate 118 (not shown in FIG. 6) along with the ground plane 122 on the reverse of the dielectric substrate. Therefore FIG. 8 shows the network 120 and the ground plane in their proper orientation. In this implementation, the substrate is Rogers RT/Duroid 6010.2 having a dielectric constant of 10.5, 1.5 inches along each side, and 0.025 inches thick. Each line segment, and the four signal paths are designated consistently with the designations described above. The network is made by conventional printed circuit method. The ground plane 122 is a metalization deposit on the reverse side of the substrate 118 (not shown in FIG. 8).

A dual frequency antenna and phase shifter can be constructed by combining a set of antenna elements suitable for a second frequency with a second phase shift network and assembling them in a single coaxial structure.

The method of the present invention in the preferred quadrifilar embodiment is to phase shift a circularly polarized signal in phase quadrature by passing the signal from 4 antenna elements, into a network in which signal transmission paths introduce a 90° phase shift in the signal path relative to the next successive signal transmission path. Successive signal transmission paths through successive tiers are equally power divided without shorting or biasing, and the network is impedance matched. Combiner line segments joining at combiner nodes are of equal electrical length and impedance at least in each tier.

FIG. 9 shows the vertical radiation gain pattern of the quadrifilar volute antenna and phase sequencer described above. This pattern was measured on the Magnavox antenna range. The polar plot represents the antenna gain in decibels relative to an isotropic antenna, as a function of the elevation angle. The isotropic antenna is designated as the 0 db circle. Referring to FIG. 9, at the zenith, the angle is 90 degrees, and the antenna is pointing directly at the target. At that point, the gain is between 3 and 4 decibels relative to isotropic. The 0 and 180 degree pointing angles are at the horizon, and antenna is pointed orthogonally relative to the target. The Gain at 0 and 180 degree angles is between 1 and 2 decibels above isotropic. At the bottom, at 270 degrees, the antenna is pointing directly away from the target, and has a loss of between 12 and 13 decibels relative to isotropic.

FIG. 10 is a plot of antenna gain (as compared to isotropic) at the zenith against frequency. Antenna gain is on the vertical scale each division representing 2 db. Frequency is on the horizontal scale each division being 60 megahertz. Plot A is a three-quarter wavelength open loop quadrifilar antenna designed by Magnavox as described above, for the GPS LI frequency, Plot B is a half wavelength closed loop antenna made by Chu Company for the GPS LI frequency which does not employ the present invention. The GPS LI frequency of 1575 megahertz is indicated on the frequency line. As can be seen Plot A shows that the gain remains high as frequency drops relative to Plot B. As frequency increases, Plot A is also more favorable than Plot B although not as dramatically as in the case of decrease in frequency.

Figure 11:
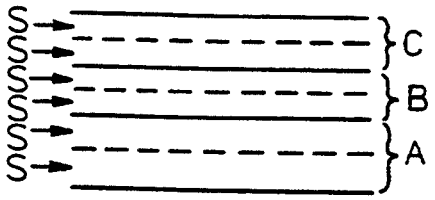
FIG. 11 is a schematic side view of a stripline multilayer form of the invention.

The invention as described above also allows construction of a stripline form of phase shift network. In FIG. 11, are shown the multilayers used to construct a stripline circuit of the quadrifilar module, using a common schematic convention in which dash lines represent the functional circuit and solid lines represent groundplanes and the spaces between, designated S, represent dielectric.

A stripline is generally a form of a microstrip in which the circuit is between two ground planes, and is frequently used in multilayer construction. Stripline construction for the present invention is implemented by breaking the network into convenient portions such as bifilar modules, and putting each portion on the face of a substrate. Appropriate ground planes are also applied. The several substrates are then laminated to form a multilayer structure, the layers being connected by plated-through holes (referred to as a "VIA"). By placing each bifilar module on a separate substrate, a surface area efficient layout, occupying a small space is possible.

In the preferred embodiment, a quadrifilar antenna is to be employed, with a quadrifilar module of the type described above, separated into its three constituent bifilar modules, each bifilar module being placed on the face of a substrate. A full description of the antenna and the phase shift network is best understood by a description of the design process.

Step 1. A volute antenna is chosen for performance and size considerations; in particular a ½ wavelength shorted loop volute is selected. The volute will have a diameter of 1.5 cm.

Step 2. The diameter and axial length of the volute determines its characteristic impedance, which is calculated by means of known techniques, and in this case is 8 ohms. The radio has an impedance of 50 ohms.

Figure 12:
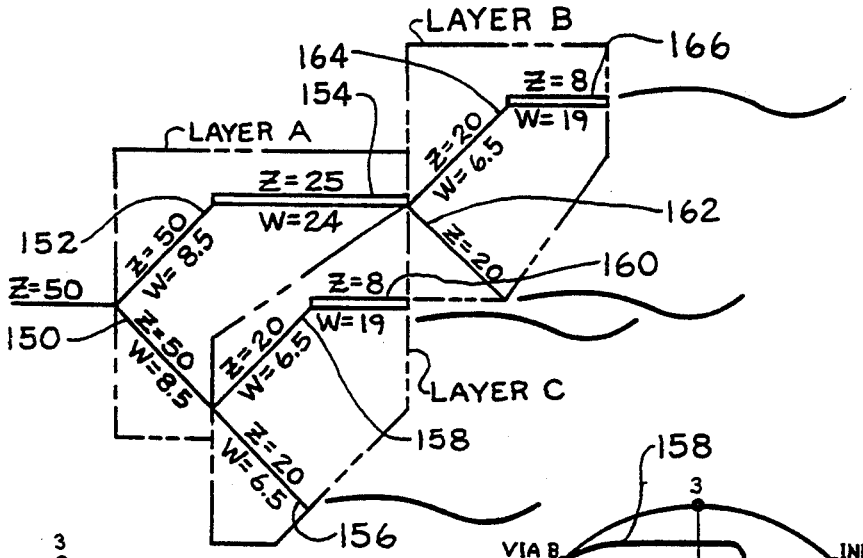
FIG. 12 is a quadrifilar schematic.

Step 3. The impedance transformations to impedance match the antenna impedance of 8 ohms and the radio impedance of 50 ohms must be calculated. As the quadrifilar network has two power splitters in tandem, an arbitrary choice for the first transformation is 25 ohms at the first power splitter. Therefore using conventional impedance matching theory the combiner line segments for the first power splitter must have impedance of 20 ohms. The second power splitter in tandem must present a 50 ohm load to the radio. Again using conventional impedance matching theory, this means that the impedance of each combiner line segment must be 50 ohms. FIG. 12 shows the impedances of each line of the quadrifilar network.

Figure 13:
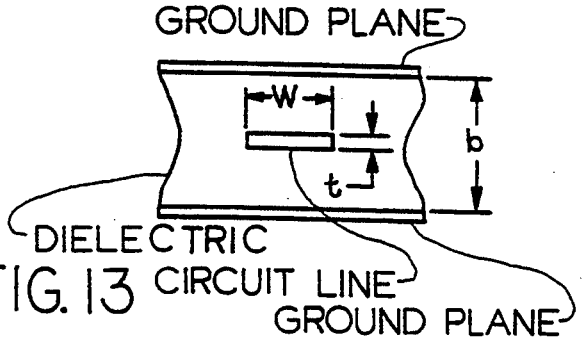
FIG. 13 is a schematic for calculating dimensions of a stripline.

Step 4. The next step is to design the physical dimensions of the stripline network. FIG. 11 shows a schematic cross section of the layered structure in which six substrates indicated by S are used to form a seven layer construction. In order to lay out the network on substrates it is necessary to calculate and choose the conductor widths which will provide the desired impedances. FIG. 13 shows the three structural variables in this analysis. The full set of variables needed in the analysis is:

$\epsilon_r$=relative dielectric constant of substrate material
$Z_0$=characteristic impedance specified for the line
b=thickness of dielectric between ground planes
t=thickness of the conductor
w=physical width of the conductor
x=an intermediate variable
m=an intermediate variable
$\Delta w$=the component of width dependent on the dielectric
w'=the effective width The calculation method proceeds as follows (see K. C. Gupta et al., Microstrip Lines and Slotlines, Artech House 1979 and references cited):

$$\text{Let } x = \frac{t}{b}$$

and $$m = 6\left\{\frac{1-x}{3-x}\right\}$$

and $$\frac{\Delta w}{b-t} = \frac{x}{\pi(1-x)}\left\{1 - \frac{1}{2}\ln\left[\left(\frac{x}{2-x}\right) + \left(\frac{0.0796\,x}{w/b + 1.1x}\right)^m\right]\right\}$$

and $$\frac{W'}{b-t} = \frac{w}{b-t} + \frac{\Delta w}{b-t}$$

and $$Z_0 = \frac{30}{\sqrt{\epsilon_r}}\ln\left(1 + \frac{4}{\pi}\,\frac{b-t}{w'}\left[\frac{8}{\pi}\,\frac{b-t}{w'} + \sqrt{\left(\frac{8}{\pi n}\,\frac{b-t}{w'}\right)^2 + 6.27}\right]\right)$$

Also a computer program named Super Compact marketed by Compact Software is available to provide the calculations. In this example the Super Compact program was used. Applying the above to the selected candidate impedances, $Z_0$, and candidate dielectric thicknesses, b, the following table of physical widths, w, in mils is constructed:

| $Z_0$ | 40 | 20 | 10 | 8 | 4 Dielectric thickness b |
|---|---|---|---|---|---|
| 50 | 15.5 | 8.5 | 4 | 3 | 1.5 |
| 25 | >49 | 24 | 12 | 10 | 5 |
| 20 | | 33 | 16 | 13 | 6.5 |

-continued

| $Z_0$ | 40 | 20 | 10 | 8 | 4 Dielectric thickness b |
|---|---|---|---|---|---|
| 8 | | >40 | >40 | 38 | 19 |

Step 5. Choose practical values for the dimension w for the selected conductor strips. In this case, the selected dimensions are underlined and are shown in FIG. 12 for each line segment. Note that in this example dielectric thickness of 20 mils (layer A) and 4 mils (layers B and C) have been chosen to provide easily realizable impedance matching from 50 ohms to 8 ohms, a relatively wide impedance ratio.

Figure 14A:
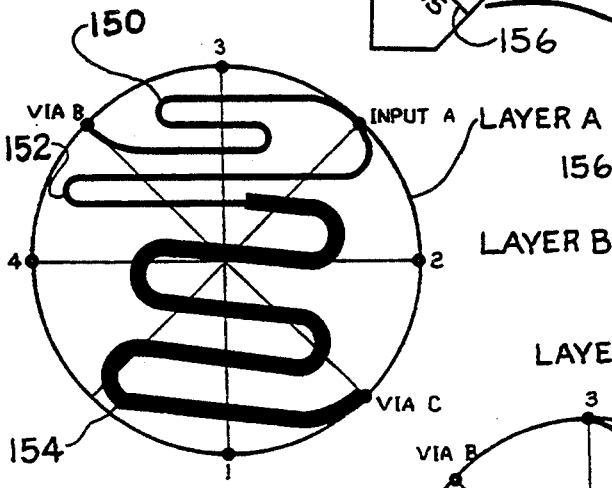
FIGS. 14A, B and C are layers of the quadrifilar of FIG. 12 laid out for multi-layer construction.
Figure 14B:
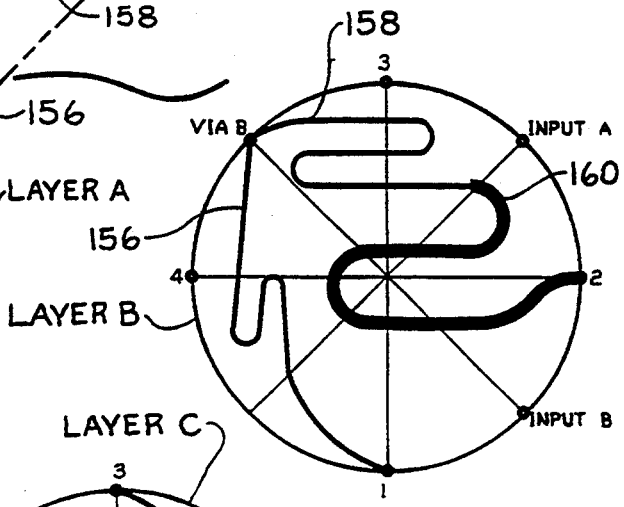
Figure 14C:
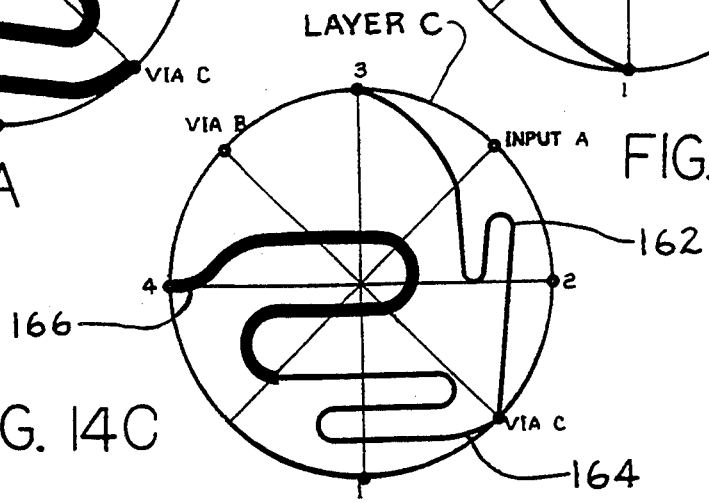

Step 6. From this, it is now possible to lay out the three bifilar modules for application to substrates and to be laminated into a single structure. These are shown in FIGS. 14 A, B and C as Layer A, Layer B and Layer C. Also the quadrifilar module as shown in FIG. 12 has double dash lines around each bifilar module, which are designated consistently with Layer A, Layer B and Layer C as shown in FIGS. 14A, B and C. The numbering in FIGS. 14A, B, and C is also consistent with that on FIG. 12. Combiner line 150 from the first combiner node at input A goes to via B, which by plated-through holes will connect to the next layer of circuit, Layer B at via B. Combiner line 152 connects to the phase shift segment 154 which in turn ends at via C and which by a plated through hole will connect to the next layer of circuit Layer C at via C. The points designated 1, 2, 3 and 4 are the points of termination of the volute antenna elements. Layer B shows a bifilar module starting at via B, having combiner line 156 to antenna element 1 and combiner line 158 which is connected to phase shift segment 160 which connects to antenna element connection point 2. Layer C shows a bifilar module extending from via C having combiner line 162 to antenna element connection point 3 and combiner lines 164 connecting to phase shift segment 166 which connects to antenna element connection point 4.

Therefore a very compact phase shift network of stripline construction can be accomplished and allow construction of a very small antenna with the high precision required and manufacturability at low cost.

Although particular embodiments of the invention have been described and illustrated herein, it is recognized that modifications and variations may readily occur to those skilled in the art, and consequently it is intended that the claims be interpreted to cover such modifications and equivalents.

We claim:

1. A phase shift network for phase shifting signals between an antenna and a radio comprising:

signal transmission paths extending between a terminal for connection to a radio and each of a plurality of terminals for connection to each of four antenna elements;

the transmission paths each having progressively equally different effective electrical lengths to provide a predetermined equal phase shift of the signal progressively through the transmission paths;

the transmission paths commencing separately from the point of connection at each antenna element, the transmission paths having combiner line segments and having adjacent path pairs being progressively joined at combiner nodes of equal power division by shunt connection of said combiner line segments such that the power at each antenna terminal is equal to the power at the radio connector terminal divided by the number of antenna terminals and absent any isolation resistor between said combiner line segments;

the transmission paths being impedance matched between the antenna element connection points and the radio connection point; and wherein there are four of said transmission paths and a first set of said combiner line segments in each of adjacent pairs of transmission paths joined at two first combiner nodes, one of said transmission paths of each of said pair of transmission paths having a 90° phase shift segment, and a second set of combiner line segments one from each of the two first combiner nodes of the first set with a 180° second phase shift segment between one of said second combiner line segments and the associated first combiner node whereby each transmission path is 90° phase shifted relative to its adjacent transmission paths.

2. The phase shift network of claim 1 wherein the said first set of combiner line segments have equal impedance and equal effective electrical length and the said second set of combiner line segments have equal impedance and equal effective electrical length.

3. The phase shift network of claim 2 wherein the said first set and the said second set of combiner line segments have equal impedance and equal effective electrical length.

4. The phase shift network of claim 3 wherein the combiner line segments have an effective electrical length of 90° of wavecycle.

5. The phase shift network of claim 4 wherein the transmission paths define one path arbitrarily as being at a zero degree reference phase an each successive path is phase shifted progressively by an equal phase shift in the amount of 90° relative phase shift between adjacent transmission paths.

6. The phase shift network of claim 1 further comprising an antenna having four antenna elements forming a volute, each antenna element being connected to one of said transmission paths.

7. The phase shift network of claim 1 wherein a second antenna is used, each antenna being designed for operation at a different frequency, the phase shift network having a second set of said signal transmission paths extending from said point of connection to a radio to points of connection to each of four second antenna elements:

the second set of transmission each having progressively equally different effective electrical lengths to provide a predetermined equal phase shift of the signal progressively through the transmission paths;

the transmission paths commencing separately from the point of connection at each of said second antenna elements, the second set of transmission path pairs having combiner line segments and being progressively joined at combiner nodes of equal power division by shunt connection of said combiner line segments such that the power at each antenna terminal is equal to the power at the radio connection terminal divided by the number of antenna connection terminals; and the second set of transmission paths being impedance matched between the antenna elements of the second antenna and a radio connection point antenna; and wherein there are four of said second set of transmission paths and a first set of said combiner line segments in each of adjacent pairs of said second set of transmission paths joined at two first combiner nodes, one of said transmission paths of each of said pair of transmission paths having 90° phase shift segment, and a second set of combiner line segments one from each of the two first combiner nodes of the first set with a 180° second phase shift segment between one of said second combiner line segments and the associated first combiner node whereby each transmission path is 90° phase shifted relative to its adjacent transmission paths.

8. The phase shift network of claim 7 wherein the said first set of combiner line segment have equal impedance and equal effective electrical length and the second set of combiner line segments have equal impedance and equal effective electrical length.

9. The phase shift network of claim 8 wherein the said first set and the said second set of combiner line segments have equal impedance and equal electrical length.

10. The phase shift network of claim 9 wherein the combiner line segments have an effective electrical length of 90° of wavecycle.

11. The network of claim 1 further comprising:

a dielectric substrate having two opposite faces the network being a printed circuit on one face of the substrate.

12. The network of claim 11 further comprising a series of terminals in the substrate defining signal ports of the network for physical and electrical connection to each antenna element;

a plated-through hole in the substrate electrically connectable to the lead wire of a coaxial line leading from the network to a radio.

13. The network of claim 12 further comprising a ground plane on the opposite face of the substrate.

14. The network of claim 13 further comprising an antenna element connected to the network at each antenna signal port.

15. The antenna of claim 14 wherein said antenna elements comprise a volute of four antenna elements.

16. The antenna of claim 15 wherein said antenna elements are $\frac{3}{4}$ wavelength in length and are of open loop configuration.

17. A phase shift device for use between a multi-element antenna and a radio comprising:

a dielectric substrate having first and second surfaces, a phase shifting network of circuit lines made by a printed circuit method on the first surface of the substrate and defining signal transmission paths between a radio connection terminal and each of a plurality of antenna element connection terminals each path being phase shifted relative to an adjacent transmission path by a predetermined amount by each path having progressively equally different effective electrical length to provide a predetermined equal phase shift of the signal progressively through the transmission paths; and wherein the transmission paths commence separately from the point of connection at each antenna element, the transmission paths having combiner line segments and adjacent path pairs being progressively joined at combiner nodes of equal power division by shunt connection of said combiner line segments such that the power at each antenna terminal is equal to the power at the radio connector terminal divided by the number of antenna terminals, the transmission paths being impedance matched between the antenna element connection points and the radio connection point and absent any isolation resistor between said combiner line segments; and wherein there are four of said transmission paths and a first set of said combiner line segments in each of adjacent pairs of transmission paths joined at two first combiner nodes, one of said transmission paths of each said first pair of transmission paths having a 90° first phase shift segment, and a second set of combiner line segments one from each of the first combiner nodes of the first set with a 180° second phase shift segment between one of said second combiner line segments and the associated first combiner node wherein each transmission path is 90° phase shifted relative to its adjacent transmission paths.

18. The phase shift device of claim 17 further comprising a ground plane on the second surface.

19. The phase shift network of claim 17 wherein said first set of the combiner line segments have equal impedance and equal effective electrical length and the second set of combiner line segments have equal impedance and equal effective electrical length.

20. The phase shift network of claim 19 wherein the said first set and the said second set of combiner line segments have equal impedance and equal effective electrical length.

21. The phase shift network of claim 20 wherein the combiner line segments have an effective electrical length of 90° of wavecycle.

22. The phase shift device of claim 17 wherein the transmission paths define one path arbitrarily as being at a zero degree reference phase and each successive path is phase shifted progressively by an equal phase shift in the amount of 90° of wavecycle to provide a 90° relative phase shift between adjacent transmission paths.

23. The phase shift device of claim 17 further comprising an antenna having four antenna elements forming a volute each antenna element being connected to one of said transmission paths.

24. The phase shift device of claim 17 wherein a second antenna is used, each antenna being designed for operation at a different frequency, the phase shift network having a second set of said signal transmission paths extending from said point of connection to a radio to points of connection to each of four second antenna elements:

the second set of transmission paths each having progressively equally different effective electrical lengths to provide a predetermined equal phase shift of the signal progressively through the transmission paths;

the transmission paths commencing separately from the point of connection at each of said second antenna elements, the second set of transmission paths having combiner line segments and having adjacent path pairs being progressively joined at combiner nodes of equal power division by the combiner line segments joined at each node having equal impedance and effective electrical length shunt connection of said combiner line segments such that the power at each antenna terminal is equal to the power at the radio connection terminal divided by the number of antenna connection terminals; and the second set of transmission paths being impedance matched between the antenna elements of the second antenna and a radio connection point antenna; and wherein there are four of said second set of transmission paths and a first set of said combiner line segments in each of adjacent pairs of said second set of transmission paths joined at two first combiner nodes, one of said transmission paths of each of said pair of transmission paths having a 90° phase shift segment, and a second set of combiner line segments one from each of the two first combiner nodes of the first set with a 180° second phase shift segment between one of said second combiner line segments and the associated first combiner node whereby each transmission path is 90° phase shifted relative to its adjacent transmission paths.

25. A network for connecting signals between an antenna having $2^n$ antenna elements, n being an integer greater than 1 and the radio network providing a predetermined phase shift between signals related sequentially to successive antenna elements the network comprising:

(1) $2^{n-1}$ phase sequencer subnetworks each subnetwork defining a bifilar module comprising:

(a) a first combiner line segment of $\phi_c$ degrees effective electrical line length having first and second ends, (b) a second combiner line segment of $\phi_c$ degrees effective electrical line length having first and second ends, the second end defining a signal port $P_1$, (c) the first and second combiner line segments each having equal impedance and equal effective electrical length $\phi_c$ degrees and being shunt connected at their first ends defining a combiner node whereby the power through each of them is equal and is ½ the power at the combiner node, (d) a phase shift line segment of $\phi_s$ degrees effective electrical length and having a first end connected to the second end of the first combiner line segment and a second end defining a signal port $P_2$, (e) the line segments being impedance matched so that the impedance at the signal ports equals the impedance at the combiner node, (2) a first tier of at least two of said bifilar modules for connection at their signal ports to antenna element, (3) at least one further successive tier each bifilar module in said successive tiers being connected at its signal ports to the combiner node of a pair of bifilar modules of the prior tier and the phase shift segment $\phi_t$ of each successive tier is given $\phi_t = 2^{A-1}\phi_s$ where $\phi_s$ is the phase shift in the first tier and A is the tier rank number whereby power at a final combiner node will be equally divided at each of the antenna elements and each antenna elements will be phase shifted by the predetermined amount $\phi_s$ relative to adjacent antenna elements and the

26. The network of claim 25 wherein $\phi_c$ is 90°.

27. The network of claim 26 wherein the phase shift $\phi_s$ is 90°.

28. The network of claim 26 wherein the circuit lines are formed on a dielectric substrate by a printed circuit method.

29. The network of claim 27 wherein the first tier has two bifilar modules and the second tier has one bifilar module thereby defining a quadrifilar module operable in phase quadrature.

30. A phase shift network for phase shifting signals between an antenna having a plurality of antenna elements and a radio, said phase shift being of a predetermined amount $\phi_s$ between successive antenna elements the network comprising;

a bifilar module of circuit lines for phase shifting signals between an antenna having two antenna elements and a radio said bifilar module comprising;

a first combiner line segment of $\phi_c$ effective electrical line length having first and second ends;

a second combiner line segment of $\phi_c$ effective electrical line length having first and second ends, the second end defining a signal port $P_1$ for connection to a first one of said antenna elements;

the first and second combiner line segments being of equal impedance and being shunt connected their at first ends defining a combiner node whereby the power through them is equal and is one half the power at the combiner node.

a phase shift line segment of $\phi_s$ degrees effective electrical length and having a first end connected to the second end of the first combiner line segment and a second end defining a signal port $P_2$ for connection to and for phase shifting a signal at a second one of said antenna elements; and said network having a plurality of said bifilar modules for use with an antenna having four antenna elements the network defining a quadrifilar phase shift module comprising;

a first of said bifilar modules connectable to two of said four antenna elements and a second bifilar module connectable to the other two of said antenna elements and a third bifilar module in which the phase shift line segment has an effective electrical length of $2\phi_s$ and is connected to the combiner node of the first bifilar module and its second combiner line segment is connected to the combiner node of the second bifilar module and having a combiner node connectable to a radio.

31. The phase shift network of claim 30 for use with an antenna having 8 elements the network defining an octifilar phase shift module comprising:

a first one of said quadrifilar modules connectable to four of said eight antenna elements and a second quadrifilar module connectable in like manner to the other four antenna elements and a bifilar module in which the phase shift line segment has an effective electrical length of $40_s$ and is connected to the first quadrifilar module and its second combiner line segment is connected to the second quadrifilar module and having a combiner node connectable to a radio.

32. The phase shift network of claim 31 for use with an antenna having sixteen antenna elements the network defining a dioctifilar phase module comprising:

a first one of said octifilar modules connectable to eight of said antenna elements and a second octifilar module connectable in like manner to the other eight antenna elements and a fifth bifilar module in which the phase shift transmission line segment has an effective electrical length of $50_s$ and is connected to the first octifilar module and its second combiner transmission line segment is connected to the second octifilar module and having a combiner node connectable to a radio.

33. A method of phase shifting signals between an antenna and a radio comprising:

providing a quadrifilar module for establishing signal transmission paths from a point of connection at the radio and points of connection at each of four antenna elements, and for phase shifting by an equal predetermined amount the signal associated with the transmission path in the quadrifilar module for each antenna element in comparison to the phase of the adjacent transmission paths wherein the signal in each transmission path starting from one path being arbitrarily defined as at a zero degree reference phase is phase shifted in the amount of 90° of wavecycle to provide a 90° relative phase shift between adjacent transmission paths;

and for equally power dividing the signal in each transmission path at each antenna element;

and for impedance matching the transmission path between each antenna element connection point and the radio connection point.

34. The method claim 33 comprising:

phase shifting the signal in each transmission path starting from one path being arbitrarily defined as at a zero degree reference phase, in the amount of 90° of wavecycle to provide a 90° relative phase shift between adjacent transmission paths.

35. The method of claim 34 for phase shifting signals between a second antenna of a different operating frequency from the said antenna and a radio comprising:

establishing second transmission paths from a point of connection at the radio and points of connection at each of two or more second antenna elements;

phase shifting by a predetermined amount the signal associated with the transmission paths for each of the second antenna elements in comparison to the phase of the signal in the transmission path of another of the second antenna elements;

equally power dividing the signal in each transmission path at each of the second antenna elements;

impedance matching the transmission path between each of the second antenna elements connection points and the radio connection point.

36. A phase shift stripline device for use between a multi-element antenna and a radio comprising:

a plurality of dielectric substrates each substrate having first and second faces formed into a multi-layer structure;

a phase shifting network of circuit lines made by a printed circuit method having portions thereof on at least some of the surfaces of the dielectric substrates defining signal transmission paths between a radio connection terminal and each of a plurality of antenna element connection terminals each transmission path being phase shifted relative to an adjacent transmission path by a predetermined amount by each path having progressively equally different effective electrical length to provide a predetermined equal phase shift of the signal progressively through the transmission paths;

wherein said transmission paths define a quadrifilar module having three bifilar modules and each bifilar module is on a separate one of the layers and the layers are stacked and the bifilar modules are connected together to form the quadrifilar module.

37. The phase shift device of claim 36 further comprising a groundplane on surfaces of the substrates to enclose each circuit line between two groundplanes.

38. The phase shifter device of claim 37 wherein the transmission paths define a quadrifilar module having three bifilar modules and each bifilar module is on a separate one of the layers and the layers are stacked and the bifilar modules are connected together to form the quadrifilar module.

39. The phase shift device of claim 38 wherein the surface of each layer opposite each bifilar module has a ground plane thereon.

40. The phase shift device of claim 38 wherein the thickness of each dielectric substrate is selected according to a predetermined $Z_0$ for each of the lines on each layer such that the impedance ratio between the antenna and the ratio is matched.

* * * * *